US008956466B2

(12) United States Patent
Blaiss et al.

(10) Patent No.: US 8,956,466 B2
(45) Date of Patent: Feb. 17, 2015

(54) PROCESS FOR PREPARING SORPTIVE SUBSTRATES, AND INTEGRATED PROCESSING SYSTEM FOR SUBSTRATES

(75) Inventors: H. Dennis Blaiss, Winston-Salem, NC (US); Laurent H. Sene, Kernersville, NC (US); Gregory T. Hall, Winston-Salem, NC (US); Randy H. Whittington, King, NC (US)

(73) Assignee: Texwipe (a division of Illinois Tool Works Inc.), Kernersville, NC (US)

( * ) Notice: Subject to any disclaimer, the term of this patent is extended or adjusted under 35 U.S.C. 154(b) by 806 days.

(21) Appl. No.: 13/195,100

(22) Filed: Aug. 1, 2011

(65) Prior Publication Data

US 2013/0031872 A1 Feb. 7, 2013

(51) Int. Cl.

| | |
|---|---|
| ***B08B 3/12*** | (2006.01) |
| ***D06B 13/00*** | (2006.01) |
| ***D06B 21/00*** | (2006.01) |
| ***A47L 13/17*** | (2006.01) |

(52) U.S. Cl.

CPC ..... *D06B 13/00* (2013.01); *D06B 21/00* (2013.01); *A47L 13/17* (2013.01)

USPC ..... 134/64 R; 134/184; 134/61; 68/3 R; 68/5 R

(58) Field of Classification Search

USPC ..... 134/184, 64 R, 61; 68/3, 5 DR, 3 R, 5 R

See application file for complete search history.

(56) References Cited

U.S. PATENT DOCUMENTS

| | | | |
|---|---|---|---|
| 2,904,981 | A | 9/1959 | Macomson |
| 3,084,020 | A | 4/1963 | Loosli |
| 3,098,370 | A | 7/1963 | Poole et al. |
| 3,395,063 | A | 7/1968 | Ralha |
| 3,496,698 | A | 2/1970 | Wichmann |
| 3,577,214 | A | 5/1971 | Levan et al. |
| 3,720,037 | A | 3/1973 | Jones |
| 3,929,409 | A | 12/1975 | Buchner et al. |

(Continued)

FOREIGN PATENT DOCUMENTS

EP 0808928 * 11/1997

OTHER PUBLICATIONS

Abstract for JP 2011 090740, "Method for Producing Wiping Tape, Wiping Tape, and Wiping Method." (1 page).

(Continued)

*Primary Examiner* — Saeed T Chaudhry

(74) *Attorney, Agent, or Firm* — Peter L. Brewer; Baker Donelson

(57) ABSTRACT

A process for treating a substrate comprised of sorptive material is provided herein. The sorptive material may be an absorbent synthetic material such as polyester. The material is designed to be used for cleaning surfaces in an ultraclean environment. The process first comprises unwinding a roll of sorptive material as a substrate into a cleaning system. The cleaning system utilizes several sections. These include a pre-washing section, an acoustic energy washing section, and a drying section. Preferably, the process of moving the substrate through the cleaning system is continuous. The acoustic energy washing section employs one or more acoustic energy generators. In one aspect, the process also includes cutting the substrate into sections to form wipers after moving the substrate through the drying section. Thereafter, the wipers are placed into a bag and the bag is sealed. An integrated treating system for a sorptive material is also provided herein.

8 Claims, 3 Drawing Sheets

(56) References Cited

U.S. PATENT DOCUMENTS

| | | | | |
|---|---|---|---|---|
| 4,193,842 | A | | 3/1980 | Rushing |
| 4,259,853 | A | * | 4/1981 | Fleissner ..... 68/5 D |
| 4,302,485 | A | * | 11/1981 | Last et al. ..... 427/601 |
| 4,424,188 | A | | 1/1984 | DiGeronimo |
| 4,569,672 | A | | 2/1986 | Marion et al. |
| 4,711,066 | A | * | 12/1987 | Fox et al. ..... 53/436 |
| 4,727,734 | A | | 3/1988 | Kanazawa et al. |
| 4,818,244 | A | | 4/1989 | Iwami |
| 4,888,229 | A | | 12/1989 | Paley et al. |
| 5,016,451 | A | * | 5/1991 | Tsukabayashi et al. ..... 68/2 |
| 5,069,735 | A | | 12/1991 | Reynolds |
| 5,097,649 | A | | 3/1992 | Ueda et al. |
| 5,165,218 | A | | 11/1992 | Callahan, Jr. |
| 5,229,181 | A | | 7/1993 | Daiber et al. |
| 5,271,995 | A | | 12/1993 | Paley et al. |
| 5,320,900 | A | | 6/1994 | Oathout |
| 5,326,316 | A | | 7/1994 | Hashimoto et al. |
| 5,623,810 | A | | 4/1997 | Dey et al. |
| 5,732,529 | A | | 3/1998 | Dey et al. |
| 5,774,177 | A | | 6/1998 | Lane |
| 5,806,282 | A | | 9/1998 | Hansen |
| 6,097,427 | A | | 8/2000 | Dey et al. |
| 6,134,866 | A | | 10/2000 | Schoenewolff et al. |
| 6,517,635 | B2 | * | 2/2003 | Mitsumori et al. ..... 134/1 |
| 6,739,160 | B1 | | 5/2004 | Hiraga et al. |
| 6,907,711 | B2 | | 6/2005 | Ishli et al. |
| 7,201,777 | B2 | | 4/2007 | Booker, Jr. |
| 7,267,150 | B2 | | 9/2007 | Shimizu et al. |
| 7,506,486 | B2 | | 3/2009 | Wegner et al. |
| 7,726,100 | B2 | | 6/2010 | Bigoni |
| 2007/0033903 | A1 | | 2/2007 | Gertitschke et al. |

OTHER PUBLICATIONS

WIPO Publication of JP 2011 090740, Method for Producing Wiping Tape, Wiping Tape, and Wiping Method. (12 pages).
English translation of JP 2011-090740 patent application (38 pages).
EP 0 808 928, "Cleaning Processing Equipment." (1977) (14 pages).
Abstract for CN 2003 20108664, "Flat Fabric Washing Machine With Ultrasound Wave Device" (1 page).
International Search Report for PCT/US 2012/048850 Mailed Nov. 12, 2012 (5 pages).
Written Opinion for PCT/US 2012/04850 mailed Nov. 12, 2012 (8 pages).
PROSYS (Product Systems Inc.) website dated Aug. 1, 2011 www.prosysmeg.com/Products/ProSys-Immersible-Array.html (1 page).
Blue Wave Ultrasonics (Blue Wave, Inc.) web pages dated Aug. 1, 2011 www.bluewaveinc.com (6 pages).
Sonics (Sonics & Materials, Inc.) product brochure printed Aug. 1, 2011 (date unknown) for VCX 1500 tubular resonator (1 page).
Telsonic (Telsonic Ultrasonics Switzerland) product brochure printed Aug. 1, 2011 (date unknown) for ultrasonic cleaning generators (3 pages).
Telsonic (Telsonic Ultrasonics Switzerland) product brochure printed Aug. 1, 2011 (date unknown) for ultrasonic tube resonators (3 pages).

* cited by examiner

PROCESS FOR PREPARING SORPTIVE SUBSTRATES, AND INTEGRATED PROCESSING SYSTEM FOR SUBSTRATES

CROSS REFERENCE TO RELATED APPLICATIONS

Not applicable.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

BACKGROUND OF THE INVENTION

1. Field of the Invention

The present invention relates to sorptive substrates. More specifically, the invention relates to an integrated process for treating and packaging sorptive substrates used for contamination control, and an integrated system for preparing wipers for use in a cleanroom environment.

2. Technology in the Field of the Invention

Cleanrooms are used in various settings. These include semiconductor fabrication plants, pharmaceutical and medical device manufacturing facilities, aerospace laboratories, and similar places where extreme cleanliness is required.

Cleanrooms are maintained in isolated areas of a building. In this respect, cleanrooms typically have highly specialized air cooling, ventilation and filtration systems to prevent the entry of air-borne particles. Individuals who enter a cleanroom will wear special clothing and gloves. Such individuals may also use specialized notebooks and writing instruments.

It is desirable to clean equipment within a cleanroom using a sorptive substrate. For example, in semiconductor fabrication cleanrooms, surfaces must be frequently wiped. In doing so, special wipes (or wipers) and cleaning solutions are used in order to prevent contamination. For such applications, the wipers themselves must also be exceptionally particle-free, and should have a high degree of wet strength and structural integrity. In this way, the wiper substrates do not disintegrate when used to wipe surfaces, even when dampened by or saturated with a cleaning liquid.

Products used in sensitive areas such as semiconductor fabrication cleanrooms and pharmaceutical manufacturing facilities are carefully selected for certain characteristics. These include particle emission levels, levels of ionic contaminants, adsorptiveness, and resistance to degradation by wear or exposure to cleaning materials. The contamination which is to be controlled is often called "micro-contamination" because it consists of small physical contaminants. Such contaminants include matter of a size between that of bacteria and viruses, and chemical contaminants in very low concentrations, typically measured in parts per million or even parts per billion.

The micro-contaminants are usually one of several types: physical particles, ions and microbials, and "extractables." Extractables are impurities leached from the fibers of the wiper. Previously, The Texwipe Company of Upper Saddle River, N.J. (now Texwipe, Division of Illinois Tool Works of Kernersville, N.C.) has developed wipers especially suited for use in particle-controlled environment. See, e.g., U.S. Pat. No. 4,888,229 and U.S. Pat. No. 5,271,995, each to Paley, et al., the disclosures of which are incorporated herein by reference in their entireties to the extent permitted by law. See also U.S. Pat. No. 5,229,181 to Daiber, et al., also incorporated herein by reference to the extent permitted by law. These patents disclose wipers for cleanroom use.

However, a need exists for an improved process for preparing absorbent and adsorbent substrates having a consistently high degree of cleanliness. In addition, a need exists for a cleaning system to generate cleanroom wipers consistently and efficiently. Further, a need exists for an integrated processing and packaging system for cleanroom wipers that operates without need of human intervention following start-up.

BRIEF SUMMARY OF THE INVENTION

A process for treating a sorptive material is first provided herein. The sorptive material preferably comprises a synthetic material such as polyester. The material is preferably placed around a core as a roll, and then unwound in order to carry the material through an integrated cleaning and packaging process.

In one aspect, the process first comprises placing a roll of sorptive material onto a shaft. The shaft may be rotated by a motor, or it may be turned by pulling the roll. The process then comprises rotating the shaft in order to unwind the roll of material as a substrate through a cleaning system.

The cleaning system will utilize several sections or zones. These may include a pre-washing section, an acoustic energy washing section, and a drying section. Optionally, the system may also utilize a rinsing section before the drying section, and a cutting section before or after the drying section.

The process also includes moving the substrate through the pre-washing section. There, a prepping fluid may be applied to at least one side of the substrate. Preferably, the prepping fluid is an aqueous solution that is sprayed onto both a front side and a back side of the substrate. Preferably, the aqueous solution comprises primarily deionized water. Optionally, the prepping fluid is a gas.

The process further includes moving the substrate through the acoustic energy washing section. There, at least one of the front side and the back side of the substrate is exposed to acoustic energy from one or more acoustic energy generators.

The acoustic energy washing section may include one or more washing stages, such as a first ultrasonic energy washing stage, a second ultrasonic energy washing stage, or both. The acoustic or sonic energy is produced within tanks holding a washing solution.

In the first ultrasonic energy washing stage, one or more tubular resonators may be used, with each of the tubular resonators operating at a frequency of, for example, about 20 to 50 kHz. In one aspect, the first ultrasonic energy washing stage includes first and second sets of rollers. The first set of rollers guides the substrate around a first transducer such that the front side of the substrate is directly exposed to ultrasonic energy from the first transducer. Similarly, the second set of rollers guides the substrate around a second transducer such that the back side of the substrate is directly exposed to ultrasonic energy from the second transducer.

In the second ultrasonic energy washing stage, one or more transducers are also used. The transducers are preferably megasonic transducers that generate acoustic energy at a frequency of about 800 kHz and 2.0 MHz or, more preferably, 900 kHz to 1.2 MHz. Preferably, the energy of the second ultrasonic washing stage is applied immediately before or after the first ultrasonic washing stage. Rollers may be used to move the substrate through the acoustic field generated by the one or more transducers.

The process further includes moving the substrate through the drying section. There, heat is applied to the cleaned sorptive material. Preferably, the heat is in the form of warmed and filtered air.

Preferably, the process of moving the substrate through the pre-washing section, the acoustic energy washing section, and the drying section is continuous, and without need of human hands other than for loading the roll of absorbent material and initially feeding it into the cleaning system.

The cleaning system may optionally utilize a rinsing section. In this situation, the process further includes moving the substrate through a rinsing section. This is done before moving the substrate through the drying section. In the rinsing section, the substrate is rinsed with an aqueous solution comprising primarily deionized water.

In one aspect, the process also includes cutting a length of the substrate. This is done after moving the substrate through the drying section. In one aspect, cutting a length of the substrate means cutting the substrate into a plurality of sections that are about 4 to 18 inches in length or, more preferably, about 12 inches in length. The step of cutting a length of the substrate may be performed by using, for example, a laser cutter or a sonic horn or knife. Thereafter, the length of substrate is, or the substrate sections are, placed into a sealed bag. Preferably, the steps of cutting the substrate and placing substrate sections into a sealed bag are automated, meaning that the steps are performed substantially without a human hand touching the sorptive material.

The sorptive material is preferably an absorbent material that is designed to be used for cleaning surfaces, equipment in an ultraclean or other controlled environment. In one embodiment, the absorbent material placed into the bags has a water absorbency of about 300 mL/$m^2$ to 650 mLg/$m^2$.

BRIEF DESCRIPTION OF THE DRAWINGS

So that the manner in which the present invention can be better understood, certain illustrations, charts and/or flow charts are appended hereto. It is to be noted, however, that the drawings illustrate only selected embodiments of the inventions and are therefore not to be considered limiting of scope, for the inventions may admit to other equally effective embodiments and applications.

DETAILED DESCRIPTION OF CERTAIN EMBODIMENTS

Definitions

As used herein, the term "move" means to translate or to otherwise guide a substrate through steps in a manufacturing process. The term "move" includes applying tension to the substrate. The term "move" may also include rotating a shaft, either by means of a motor applying rotational force, by applying tension to a substrate to unwind the substrate, or both.

Discussion of Specific Embodiments

Figure 1A:
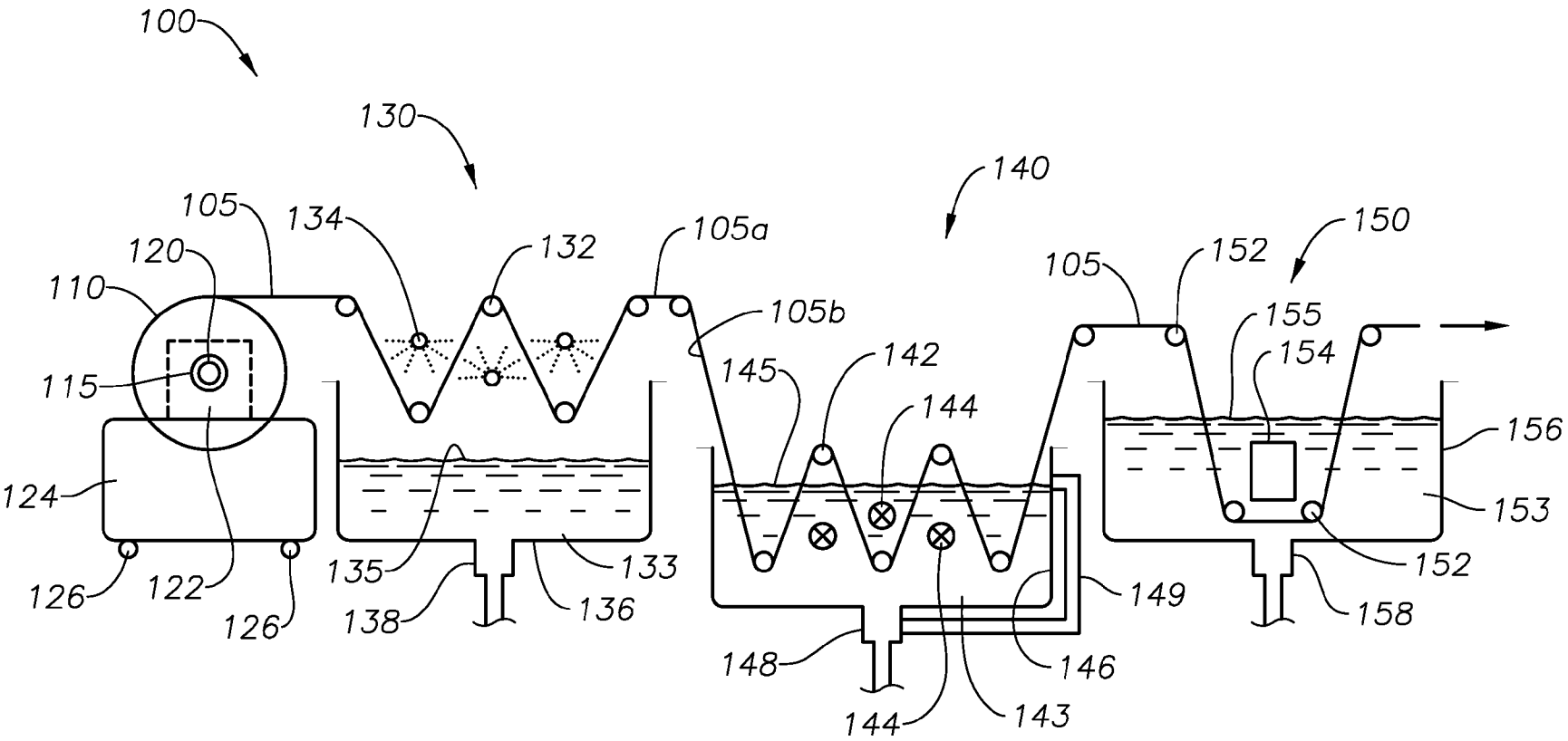
FIGS. 1A and 1B together demonstrate a treatment and packaging process of the present invention, in one embodiment. The process is used for preparing sorptive substrates, preferably without human intervention after start-up.
Figure 1B:
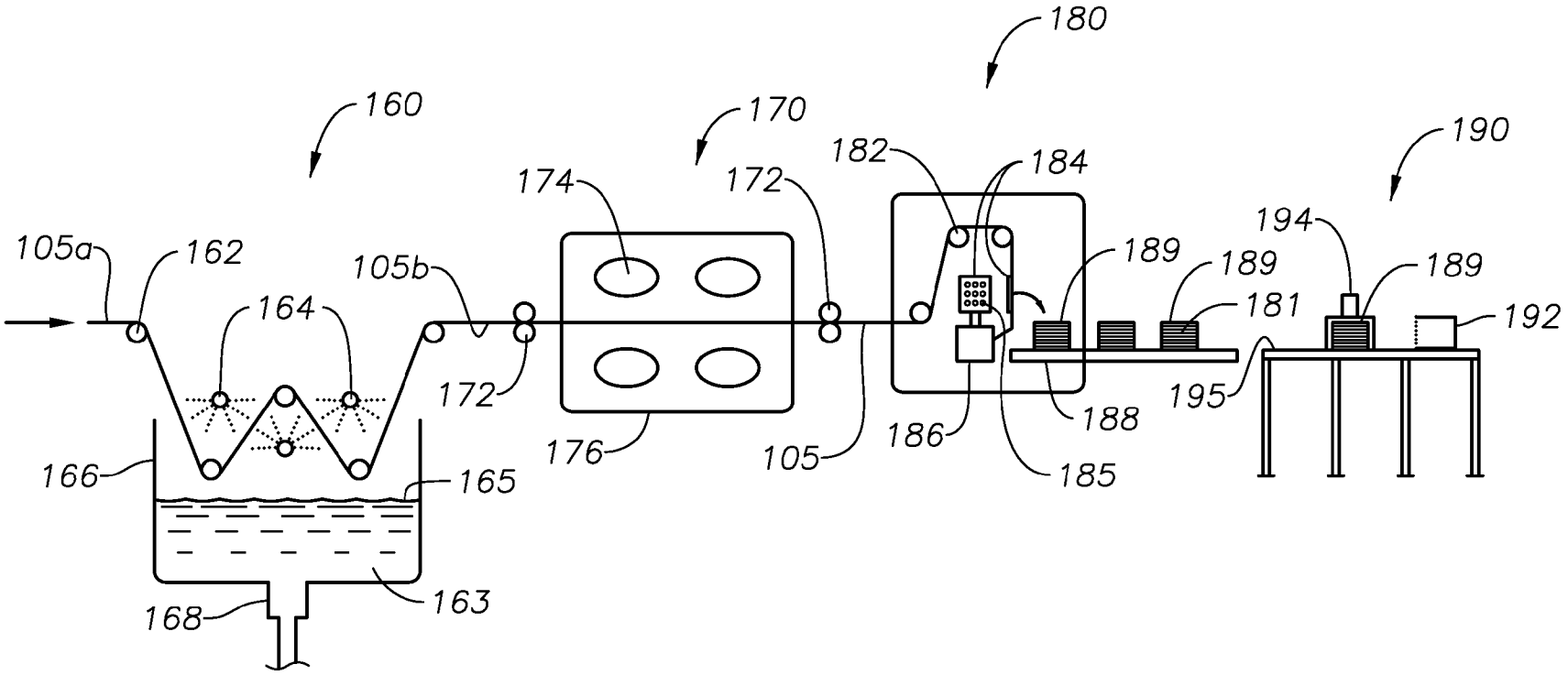

FIGS. 1A and 1B together present a treating and packaging process 100 of the present invention, in one embodiment. The process 100 utilizes a system for cleaning and packaging substrates that are absorptive, adsorptive, or both. While the reference number "100" is referred to herein as a process, reference number 100 is also indicative of a system containing a series of sections for carrying out a treating and packaging process.

The sorptive substrates of the process 100 are preferably fabricated from a synthetic material such as polyester or nylon. The material is provided as a roll 110. The material is processed and then wrapped around a core 115 to serve as the roll 110. The substrate roll 110 may have, for example, about 900 feet (274.3 meters) of material. The sorptive material is then unwound as a substrate 105 in order to carry the material through the treating and packaging process 100.

The substrate roll 110 represents a large roll of sorptive material. Preferably, the roll 110 comprises a knit polyester material. The polyester material may be, for example, polyethylene terephthalate (PET). Other polyester materials that may be used include, for example, polybutylene terephthalate, polytrimethylene terephthalate, polycaprolactone, polyglycolide, polylactide, polyhydroxybutyrate, polyhydroxyvalerate, polyethylene adipate, polybutylene adipate, polypropylene succinate, and so forth). Wipers fabricated from polyester materials are commercially available under the trademark VECTRA® provided by ITW Texwipe of Kernersville, N.C. Examples of such wipers are described at http://www.texwipe.com.

Other synthetic materials may be used. These include, for example, polyamide, polyacrylonitrile, polyparaphenyleneterephthalamide, polyamides (such as, for example, Nylon 6, Nylon 6/6, Nylon 12, polyaspartic acid, polyglutamic acid, and so forth), polyamines, polyimides, polyacrylics (such as, for example, polyacrylamide, polyacrylonitrile, esters of methacrylic acid and acrylic acid, and so forth), polycarbonates (such as, for example, polybisphenol), polydienes (such as, for example, polybutadiene, polyisoprene, polynorbornene, and so forth), polyepoxides, polyethers (such as, for example, polyethylene glycol (polyethylene oxide), polybutylene glycol, polypropylene oxide, polyoxymethylene (paraformaldehyde), polytetramethylene ether (polytetrahydrofuran), polyepichlorohydrin, and so forth), polyolefins (such as, for example, polyethylene, polypropylene, polybutylene, polybutene, polyoctene, and so forth), polyphenylenes (such as, for example, polyphenylene oxide, polyphenylene sulfide, polyphenylene ether sulfone, and so forth), silicon containing polymers (such as, for example, polydimethyl siloxane, polycarbomethyl silane, and so forth), polyurethanes, polyvinyls (such as, for example, polyvinyl butyral, polyvinyl alcohol, esters and ethers of polyvinyl alcohol, polyvinyl acetate, polystyrene, polymethylstyrene, polyvinyl chloride, polyvinyl pryrrolidone, polymethyl vinyl ether, polyethyl vinyl ether, polyvinyl methyl ketone, and so forth), polyacetals, and polyarylates.

In addition, a blend of polyester and cellulosic materials may be used, although the inclusion of cellulosic fibers in ultra-clean applications is discouraged. A blend of woven and nonwoven synthetic materials may also be used.

Referring to FIG. 1A, the illustrative process 100 first comprises placing the roll of sorptive material 110 onto a shaft 120. The shaft 120 may be rotated by a motor 122 which unwinds the substrate roll 110 at a predetermined rotational rate. Preferably, the roll 110 is unwound or moved through the process 100 at a rate of about 22 feet/minute (0.11 meters/second).

The motor 122, in turn, may be supported by a support stand 124. The support stand 124 may be stationary; alternatively, the support stand 124 may be portable. In the view of FIG. 1A, the support stand 124 includes wheels 126 for moving the roll 110 of absorbent material and motor 122 into place. In either instance, the process 100 next comprises rotating the shaft 120 and attached core 115 in order to unwind the roll of absorbent material 110.

The polyester material 110 is unwound as a substrate 105. The substrate 105 is preferably between about 4 inches (10.16 cm) and 18 inches (45.7 cm) in width. In this stage, the substrate 105 may be referred to as a "web" or as a "slit roll."

The substrate 105 is taken through a series of treating sections or zones as part of the process 100. These may include a pre-washing section 130, an acoustic energy washing section 140, 150 a rinsing section 160, and a drying section 170. Preferably, the process 100 also utilizes a cutting section 180 before or after the drying section 170, and a packaging section 190.

As seen in FIG. 1A, the process 100 includes moving the substrate 105 through the pre-washing section 130. There, a prepping fluid 133 is sprayed onto the absorbent material making up the substrate 105. In one aspect, the prepping fluid 133 is an aqueous solution 133 that is sprayed onto both a front side 105*a* and a back side 105*b* of the substrate 105. Preferably, the aqueous solution 133 comprises primarily deionized water. Spray nozzles 134 are used for applying the aqueous solution 133.

Alternatively, the prepping fluid 133 is a gaseous solution. The gaseous solution may comprise, for example, carbon dioxide, ozone, steam, or combinations thereof.

In order to introduce the substrate 105 into the pre-washing section 130, an operator will initially unwind a leading edge of the substrate roll 110. This process is done manually, however, the pre-washing section 130 and other sections of the process 100 are preferably automated, that is, carried out without human hands in order to ensure cleanliness and increase efficiency.

To aid the movement of the substrate 105 through the pre-washing section 130, a plurality of nip rollers 132 may be employed. The nip rollers 132 allow the substrate 105 to move between spray nozzles 134, permitting both the front side 105*a* and the back side 105*b* of the substrate 105 to be wetted. Preferably, the nip rollers 132 define tubular objects fabricated from stainless steel or other material that may be easily cleaned or even sterilized.

It is understood that the arrangement of rollers 132 and spray nozzles 134 in FIG. 1A is merely illustrative; other arrangements, such as an arrangement where a pair of nozzles 134 sprays water or gaseous fluid onto only one side of the substrate 105, may be employed.

In any arrangement, the aqueous solution or other prepping fluid 133 condenses or falls into a container 136 where it is briefly collected. The aqueous solution 133 is then directed into a drain 138. From there, the aqueous solution 133 may be filtered and re-used. A water line 135 is indicated in FIG. 1A. In one embodiment, the lowest nip rollers 132 may actually extend a few inches below the water line 135.

The process 100 also includes moving the substrate 105 through an acoustic energy washing section. In the arrangement of FIG. 1A, the acoustic energy washing section actually comprises two stages, denoted as 140 and 150.

Stage 140 represents a first ultrasonic energy washing stage. There, the front side 105*a* and the back side 105*b* of the absorbent material are exposed to ultrasonic energy. The ultrasonic energy is supplied by one or more energy generators 144. The energy generators 144 create many hundreds (if not thousands) of imploding gas bubbles which produce micro-blast waves.

The energy generators 144 preferably comprise tubular resonators. The tubular resonators represent an ultrasound transducer and an electronic power supply. The tubular resonators 144 are adapted for generating and supplying acoustic energy to the substrate 105 within the ultrasonic washing stage 130. The frequency of the generated energy is preferably in the range from about 20 kHz to about 80 kHz, and more preferably from about 20 kHz to about 50 kHz, and more preferably about 40 kHz. The power input to the resonators 144 is preferably in the range from about 20 W to about 250 W per gallon of washing solution 143.

The ultrasonic transducers may be, for example, PZT (Lead-Zirconate-Titanite) transducers or magnetostrictive transducers. One example of a suitable commercial transducer is the Vibra-Cell VCX series from Sonics & Materials Inc. of Newtown, Conn.

The energy generators 144 of FIG. 1A are intended to represent tubular resonators and may be referred to as such herein. However, it is understood that the energy generators 144 may also be plates or other energy generators that generate acoustic energy within the ultrasonic frequency range, preferably between 20 kHz and 50 kHz. The energy generators 144 may be, for example, piezoelectric transducers produced by Electrowave Ultrasonics Corporation of Escondido, Calif.

The resonators 144 reside in a tank 146. In the arrangement of FIG. 1A, a pair of tubular resonators 144 is schematically shown. However, it is understood that a single resonator 144 may be employed, or more than two resonators 144 may be provided. In one aspect, an array of several resonators may be placed within the tank 146. Preferably, the tubular resonators 144 are "tuned" according to the geometry of the tank 146.

The resonators 144 are placed in close proximity to the substrate 105. The resonators 144 delivery high-frequency sonic energy, which causes cavitation. This, in turn, increases the micro-turbulence within the absorbent material by rapidly varying pressures in the acoustic field. If the acoustic waves generated in the field have a high-enough amplitude, a phenomenon occurs, known as cavitation, in which small cavities or bubbles form in the liquid phase. This is due to liquid shear, followed by rapid collapse. After sufficient cycles, the cavitation bubbles grow to what may be called resonant size, at which point they implode violently in one compression cycle, producing local pressure changes of several thousand atmospheres.

The tank 146 holds a washing solution 143 for cleaning the substrate 105. The washing solution 143 preferably comprises deionized water and a surfactant as is known in the art of textile cleaning. Preferably, the water portion is heated. A drain 148 may be provided for receiving the washing solution 143 as the washing solution 143 is changed out or cycled.

A fluid line 145 is indicated within the tank 146. This represents a level of the washing solution 143 during washing. Optionally, a side draw 149 is provided that skims water off of the fluid line 145. In this way, any floating NVR's (non-volatile residue) is removed from the tank 146.

To aid the movement of the substrate 105 through the ultrasonic energy washing stage 140, a plurality of rollers 142 may be employed. The rollers 142 allow the substrate 105 to move between the energy generators 144, permitting both the front side 105*a* and the back side 105*b* of the substrate to be exposed. The rollers 142 are preferably cylindrical devices fabricated from stainless steel.

In an alternative arrangement, the energy generators 144 may be mounted at the bottom or on the sidewalls of the tank 146. This is not preferred as it limits the ability to contact both sides 105*a*, 105*b* of the substrate with the acoustic energy. In any event, it is preferred that the substrate 105 be submerged below the fluid line 145 so as to be washed by the washing solution 143 and the acoustic action of the energy generators 144.

In one aspect, the first ultrasonic washing section 140 includes first and second sets of rollers 142. The first set of rollers guides the sorptive material of the substrate 105 around a first energy generator such that the front side 105*a* of the sorptive material is directly exposed to ultrasonic energy from the first energy generator. Similarly, the second set of rollers guides the sorptive material of the substrate 105 around a second energy generator such that the back side 105*b* of the sorptive material is directly exposed to ultrasonic energy from the second energy generator.

Stage 150 of the acoustic energy washing section represents a megasonic energy washing stage. There, the front side 105*a* and the back side 105*b* of the sorptive material are exposed to megasonic energy. The megasonic energy is supplied by at least one energy generator 154. The energy generator 154 creates many millions (if not billions) of imploding gas bubbles which produce micro-blast waves.

The energy generator 154 is preferably a transducer connected to an electronic power supply. The transducer 154 is adapted for generating and supplying acoustic energy to the substrate 105 within the megasonic washing stage 150. The frequency of the generated energy is preferably in the range from about 800 kHz to about 1,200 kHz, and more preferably from about 900 kHz to about 1,100 kHz, and more preferably about 1 MHz. The transducer is preferably composed of piezoelectric crystals that generate acoustic energy. The acoustic energy, in turn, creates cavitation within a water tank.

The megasonic transducer 154 may be, for example, a magnetostrictive transducer produced by Blue Wave Ultrasonics of Davenport, Iowa, or megasonic sweeping generators provided by Megasonic Sweeping, Inc, of Trenton, N.J.

The transducer plate 154 resides in a tank 156. In the arrangement of FIG. 1A, a single transducer plate 154 is schematically shown. However, it is understood that more than one transducer plates 154 may be employed. Preferably, the transducer plate 154 is "tuned" according to the geometry of the tank 156.

The tank 156 holds a washing solution 153 for cleaning the substrate 105. The washing solution 153 preferably comprises deionized water and a surfactant as is known in the art. Preferably, the water portion of the washing solution 153 is heated. A drain 158 is provided for receiving the washing solution 153 after a wash cycle.

A fluid line 155 is indicated within the tank 156. This represents a level of the washing solution 153 during acoustic cleaning.

To aid the movement of the substrate 105 through the megasonic energy washing stage 150, a plurality of nip rollers 152 may be employed. The rollers 152 allow the substrate 105 to move around the transducer 154, permitting at least one side of the substrate 105 to be directly exposed to acoustic energy. The transducer 154 may optionally be mounted at the bottom or on a sidewall of the tank 156. In any event, it is preferred that the substrate 105 be submerged below the fluid line 145 so as to be washed by the washing solution 143 and the acoustic action of the energy generator 154 simultaneously.

In the arrangement of FIG. 1A, the first ultrasonic energy washing stage 140 is placed before the second ultrasonic energy washing stage 150. However, it is understood that the second ultrasonic energy washing stage 150 may be placed before the first ultrasonic energy washing stage 140. Thus, acoustic energy in the megasonic frequency range may be applied either before or after acoustic energy in the ultrasonic frequency range.

The process 100 also includes moving the substrate 105 through a rinsing section 160. There, an aqueous solution 163 is sprayed onto the substrate 105 using spray nozzles 164. In one aspect, the aqueous solution 163 is sprayed onto both the front side 105*a* and the back side 105*b* of the substrate 105. Preferably, the aqueous solution comprises primarily deionized water.

To aid the movement of the substrate 105 through the rinsing section 160, a plurality of nip rollers 162 may be employed. The rollers 162 allow the substrate 105 to move over, under, or between spray nozzles 164, permitting both the front side 105*a* and the back side 105*b* of the substrate 105 to be sprayed. Preferably, the rollers 162 are cylindrical devices fabricated from stainless steel.

The deionized water 163 is captured in a container 166, and is then directed into a drain 168. From there, the water may be filtered and re-used. A water level 165 is indicated in FIG. 1B. In one embodiment, the lowest rollers 162 actually extend a few inches below the water level 165.

After being rinsed, the sorptive material making up the substrate 105 is moved through the drying section 170. There, heat is applied to the cleaned or treated material. Preferably, the heat comprises warmed and HEPA-filtered air. The air is delivered through one or more heating units 176. Each heating unit 176 includes one or more blowers or fans 174 for gently applying the warmed air across the front 105*a* and/or back 105*b* sides of the substrate 105.

In order to aid the movement of the substrate 105 through the drying section 170, one or more nip rollers 172 may be provided. In the arrangement of FIG. 1B, rollers 172 are disposed before and after the heating unit 176.

Preferably, the process of moving the substrate 105 through the pre-washing section 130, the acoustic energy washing sections 140/150, the rinsing section 160, and the drying section 170 is continuous. In order to move the substrate 105 through the preparation process 100, the substrate 105 is guided and gently pulled by a series of rollers. Thereafter, the substrate 105 is cut into individual sections.

FIG. 1B demonstrates illustrative movement of the substrate 105 from the heating unit 176 into a cutting section 180. In the cutting section 180, the substrate 105 is guided by rollers 182 onto one of several paddles 184. The paddles 184 rotate on a carousel 186. In operation, a length of substrate 105 is laid upon a paddle 184. The substrate 105 is held in place on the paddle 184 by means of a gentle vacuum applied through holes 185 in the respective paddles 184. In one aspect, the paddle 184 is held in a substantially vertical position, and a hose (not shown) delivers suction through the holes 185 in the upright paddle 184. The length of substrate 105 is then cut using either a laser or a blade (not shown). Alternatively, sections of substrate 105 are cut using heat energy or sonic energy that serves to seal or fuse the borders of the sections. For example, a sonic knife or sonic horn may be employed.

The length of substrate 105 is preferably cut into sections that are 4 inches (10.16 cm), 9 inches (22.9 cm), 12 inches (30.5 cm), or even 16 inches (40.6 cm) in length. In one aspect, each section is 12"×12". Alternatively, each section may be about 9"×12". Individual sections are indicated at 181.

Because of the negative pressure applied to the back side of the length of substrate 105, each newly cut section 181 of substrate remains on the paddle 184 even after cutting. The paddle 184 is then rotated down about 90 degrees, whereupon the vacuum is removed and the section 181 of substrate is released. In the view of FIG. 1B, a stack 189 of substrate sections 181 is shown.

After a section 181 of substrate is released, the carousel 186 is rotated. A new paddle 184 receives a next length of substrate, and presents it to the laser or blade. The length of substrate is cut, and a newly cut section 181 is then placed onto the stack 189. This process is repeated in order to cut more sections 181 of substrate, and lay them upon the stack 189.

After a designated number of cycles, such as 50, 75, or 100, the stack 189 of substrate sections 181, or "wipers," is moved along a conveyor belt 188 (or other translation device). Using the conveyor belt 188, the stack 189 of wipers is delivered to a packaging section 190. The packaging section 190 then places the wipers as a stack 189 onto a surface 195.

The packaging section 190 is preferably automated, meaning that stacks 189 of wipers are placed into bags without need of human hands. In one aspect, a bag 192 is presented to a stack 189. A pulse of air opens the bag 192 at an end, and two flippers (not shown) partially rotate to hold the end of the bag 192 open. Thereafter, a stack 189 is moved into the bag 192, and the bag 192 is moved away for sealing. Placement of the wipers into the bag 192 is done automatically using a plunger 194. In this way, the sorptive material is not touched by human hands.

Each section 181 of substrate that is cut (that is, each wiper) preferably has between about $0.5\times10^6$ and $5.0\times10^6$ particles and fibers per square meter that are between about 0.5 and 5.0 μm. In addition, each wiper preferably has between about 30,000 and 70,000 particles and fibers per square meter that are between about 5.0 and 100 μm in length. In addition, each wiper preferably has less than 150 fibers per square meter that are greater than 100 μm.

In one aspect, each wiper has less than about 0.06 ppm potassium, less than about 0.05 ppm chloride, less than about 0.05 ppm magnesium, less than about 0.20 ppm calcium, and less than about 0.30 ppm sodium. In another aspect, each wiper has less than about 0.20 ppm sulfate. In another aspect, each wiper has about 0.02 g/m$^2$ IPA extractant, and about 0.01 g/m$^2$ DIW extractant. In another aspect, each wiper has about 0.02 g/m$^2$ IPA extractant, and about 0.01 g/m$^2$ DIW extractant. In yet another aspect, each wiper has a water absorbency of between about 300 mL/m$^2$ to 650 mL/m$^2$, and more preferably about 450 mLg/m$^2$.

Figure 2:
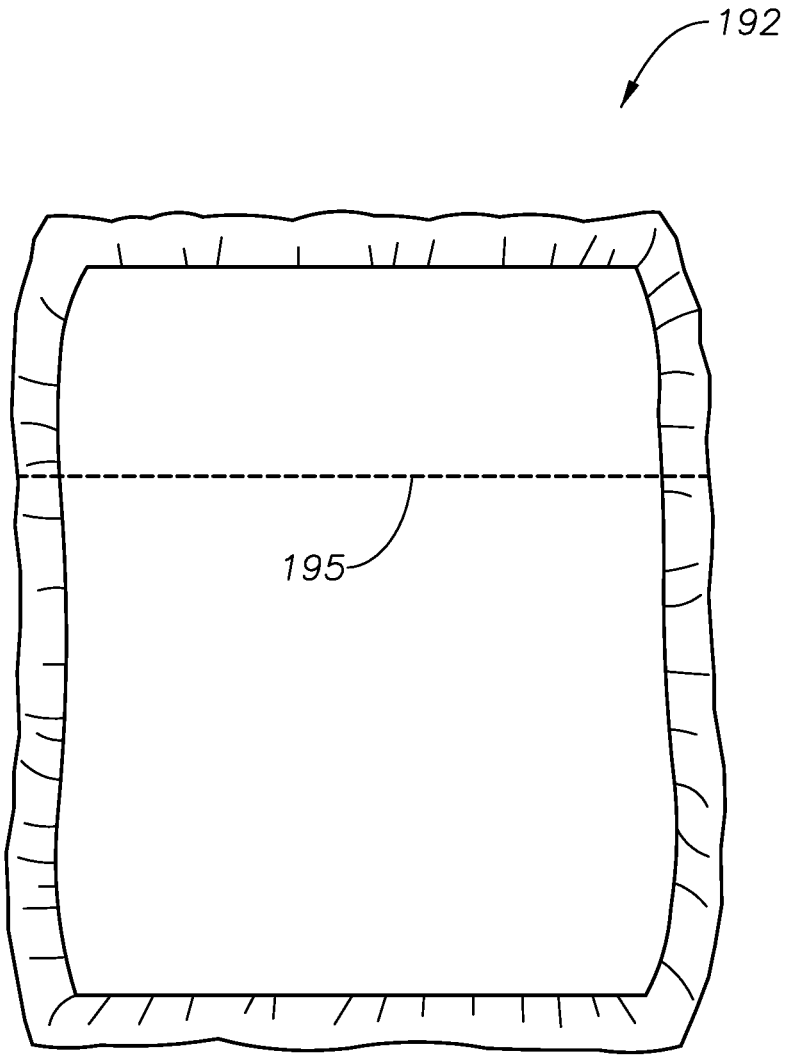
FIG. 2 is a perspective view of a bag as may be used as a package of absorbent substrate, after the substrate has been cut or folded into sections.

FIG. 2 is a perspective view of an illustrative bag 192 as may be used as a package for sorptive substrate. The bag 192 receives sections of sorptive material, or wipers, after the substrate 105 has been cut into sections in the cutting section 180. Thereafter, the bag 192 is sealed. As shown in FIG. 2, the bag 192 includes a perforation 195, enabling a user to readily open the sealed bag 192 in a cleanroom.

The bag 192 may be used by an end user for cleaning a surface in a cleanroom. Accordingly, a method of cleaning a surface is provided herein. The method includes receiving a package of wipers. The wipers have been packaged in a processing system such as the system described above for the process 100 in its various embodiments. The method further includes opening the package of wipers, removing one of the wipers, and using the removed wiper to wipe a surface in a cleanroom environment.

As can be seen, an improved process for packaging an absorbent or adsorbent material is provided. It is noted that the arrangement shown for the process 100 in FIGS. 1A and 1B is merely illustrative. For example, the pre-washing section 130, the acoustic energy washing section 140,150, the rinsing section 160, and the drying section 170 may be incorporated into a module having a smaller footprint. The footprint may be, for example, only 30 feet by 30 feet (or about 83.6 m$^2$). The module may be equipped with cameras in the various sections for monitoring the progress of the substrate 105 through the sections 130, 140, 150, 160, 170.

While it will be apparent that the inventions herein described are well calculated to achieve the benefits and advantages set forth above, it will be appreciated that the inventions are susceptible to modification, variation and change without departing from the spirit thereof.

We claim:

1. A treating system for receiving a roll of sorptive material as a substrate and treating the sorptive material, the treating system comprising:

an acoustic energy washing section configured to expose each of a front side and a back side of the substrate to energy pulses from acoustic energy generators within a tank of a washing solution, with at least one of the acoustic energy generators being a tubular resonator that operates at a frequency of between about 20 and 50 kHz, thereby producing a cleaned sorptive material;

a drying section configured to apply warmed and HEPA-filtered air to the cleaned sorptive material after the substrate has passed through the washing section;

a cutting section configured to continuously cut the substrate into individual wipers after the substrate has passed through the drying section, and to place the wipers into a horizontal stack;

a packaging section configured to continuously receive each stack of wipers, and place them into a bag substantially without need of human hands for use in wiping surfaces in a cleanroom environment; and wherein after having been cleaned and dried, the sorptive material uniformly has less than 150 contaminant fibers per square meter that are greater than 100 μm in length wherein the acoustic energy washing section comprises: a first set of rollers for guiding the substrate around a first transducer such that the front side of the substrate is directly exposed to ultrasonic energy from a first transducer; and a second set of rollers for guiding the substrate around a second transducer such that the back side of the substrate is directly exposed to ultrasonic energy from the second transducer.

2. The treating system of claim 1, wherein the sorptive material comprises primarily polyester.

3. The treating system of claim 1, wherein:

the sorptive material is an absorbent material, an adsorbent material, or both;

the roll of sorptive material is between about 4 inches (10.16 cm) and 18 inches (45.72 cm) in width.

4. The treating system of claim 3, wherein:

the sorptive material is an absorbent material; and the absorbent material has an absorbency of between about 300 mL/m$^2$ to 650 mL/m$^2$.

5. The treating system of claim 3, further comprising:

a pre-washing section configured to receive the roll of sorptive material as a substrate, and to spray a prepping fluid onto the sorptive material before the substrate moves into the acoustic energy washing section.

6. The treating system of claim 5, wherein the prepping fluid in the pre-washing section (i) is a liquid that comprises primarily deionized water, (ii) is a gaseous fluid comprising carbon dioxide, steam, ozone, or mixtures thereof, or (iii) combinations thereof.

7. The treating system of claim 6, further comprising:

a rinsing section configured to continuously receive the substrate from the acoustic energy washing section, and rinse the substrate by spraying deionized water before drying;

a stand having a shaft for supporting the roll of sorptive material; and a motor for rotating the shaft in order to unwind the roll of sorptive material as a substrate into the pre-washing section.

8. The treating system of claim 1, wherein:

the acoustic energy washing section comprises a second acoustic energy washer; and the one or more energy generators comprises at least one megasonic transducer that operates at a frequency of between about 900 kHz and 2.0 MHz.

* * * * *